United States Patent [19]

Kirkham

[11] 3,965,915

[45] June 29, 1976

[54] TENT STRUCTURE

[76] Inventor: Arthur J. Kirkham, 24 W. Fifth South, Salt Lake City, Utah 84101

[22] Filed: Oct. 6, 1972

[21] Appl. No.: 295,516

[52] U.S. Cl. ..... 135/1 R; 135/14 D; 135/14 V; 135/5 B

[51] Int. Cl.[2] ..... E04B 1/347; A45F 1/00

[58] Field of Search ..... 135/1 R, 5 R

[56] References Cited

UNITED STATES PATENTS

| | | | |
|---|---|---|---|
| 1,247,882 | 11/1917 | Row | 135/1 R |
| 2,932,304 | 4/1960 | Voege et al. | 135/1 R |
| 3,468,321 | 9/1969 | Thompson | 135/1 R |

FOREIGN PATENTS OR APPLICATIONS

| | | | |
|---|---|---|---|
| 727,178 | 3/1955 | United Kingdom | 135/1 |

*Primary Examiner*—H. Hampton Hunter
*Assistant Examiner*—Conrad L. Berman
*Attorney, Agent, or Firm*—B. Deon Criddle

[57] ABSTRACT

A modular tent shelter including basic tent modules having a fully enclosable low profile sleeping area and a sheltered standing area. The sheltered portions of two of the modular units can be interconnected to form a fully enclosable, standing or storage area or can be interconnected by an accessory modular unit to form an enlarged standing or storage area and room.

8 Claims, 7 Drawing Figures

TENT STRUCTURE

BRIEF DESCRIPTION OF THE INVENTION

1. Field of the Invention

This invention relates to tent structures and particularly to such structures, adapted for use by back packers and the like.

2. Prior Art

Back packing tent structures have long been known. Such structures generally have been made as lightweight as possible and this generally has involved making them so small that a user can do no more than sleep in them. The materials used have been lightweight so that a single individual or pair of individuals can readily carry a complete tent unit. Principal drawbacks to such tent units are that they do not allow for a user to optionally stand within a sheltered area as he dresses or undresses, performs cooking functions or other activities and they cannot be selectively enlarged, if desired. The prior art back packing tent units with which I am familiar, have not been usable as component units to form larger structures or for attachment to fixed larger structures, whereby they become sleeping units of a generally larger tent assembly.

Principal objects of the present invention are to provide a tent structure, suitable for use by back packers and affording both a sleeping unit and a sheltered standing area. Another object is to provide a tent structure that can be optionally altered for various occasions and uses to accommodate one or two individuals or a whole family.

Other features are to provide such a tent unit as a modular component interconnectable with other similar units to provide enclosed sleeping areas and enclosed standing area or with other tent accessory units to form a greatly enlarged tent structure.

Still other features are to provide a modular tent unit that can be readily attached to a free-standing pavilion, thereby providing a sleeping unit component of the pavilion.

Principal features of the invention include a modular unit formed with a sleeping area that can be totally enclosed and that preferably has a low roof line, whereby a minimum weight is maintained. The basic modular unit has interconnected, upstanding wing portions projecting forwardly of a door face thereof to form a shelter defining a standing area when the tent unit is erected. Means are provided on the wing portions of each basic modular unit whereby it can be readily coupled to the wing portions of a similarly constructed modular unit, or to an interconnecting modular unit positioned between wing portions of modular units. The coupling means also enables the wings to be attached to other independently supported tent pavilions.

Additional objects and features of the present invention will become apparent from the following detailed description, taken together with the accompanying drawings.

THE DRAWINGS

In the drawings:

FIG. 1 is a side elevation view of a basic modular unit of the invention;

FIG. 2, a front elevation view;

FIG. 3, a rear elevation view;

FIG. 4, a top plan view;

FIG. 5, a side elevation view of two of the basic modular units coupled together with a standing or storage area formed therebetween and with one wing portion shown loose to serve as a doorway;

FIG. 6, a view like that of FIG. 5, but showing an accessory modular unit interconnected between the basic modular units; and FIG. 7, a perspective view of the modular units of FIG. 6, but showing one flap of the accessory modular unit in a raised supported position to serve as an awning to provide an area sheltered from the sun, wind or inclement weather.

DETAILED DESCRIPTION

Figure 1:
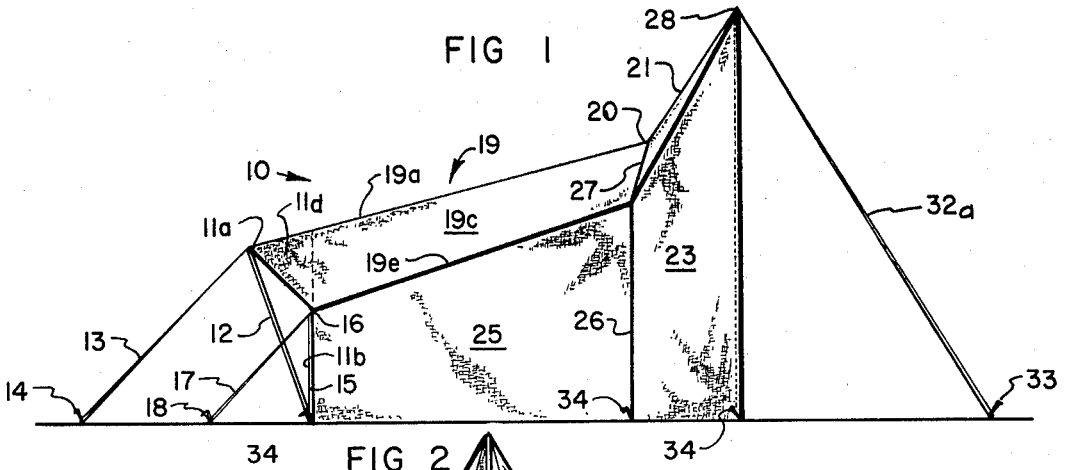
Figure 2:
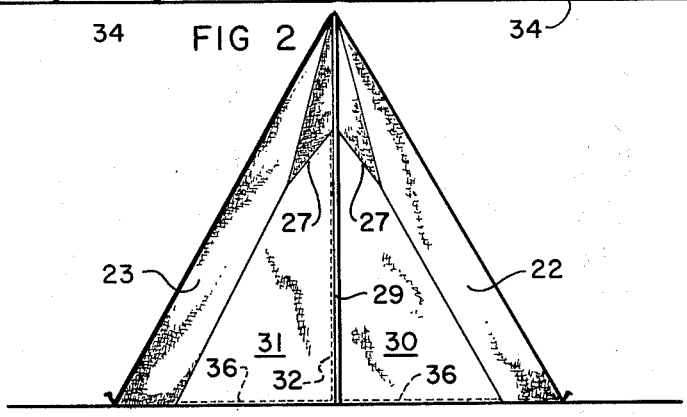
Figure 3:
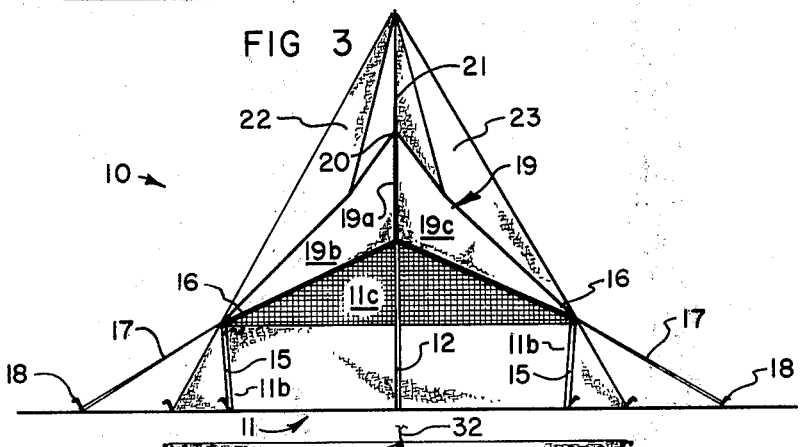
Figure 4:
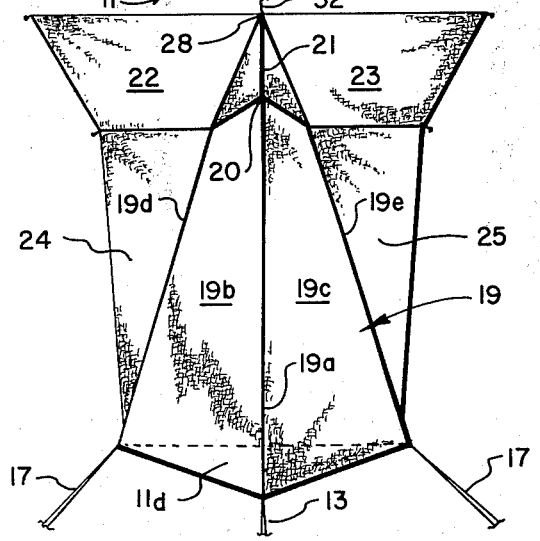

Referring now to the drawings:

In the illustrated preferred embodiment, there is provided a basic modular tent unit, shown generally at 10. The basic modular tent unit, in its erected condition, includes a rear wall 11 that is peaked at a central portion 11a and that has upper edges extending angularly downwardly therefrom to upstanding side edge portions 11b. A screened type window 11c is provided in the upper portion of wall 11 and a flap **11*d* is provided to cover the screened window in conventional fashion. A support rod 12 extending from the ground, upwardly to engage a grommeted flap provided therefor at peak 11*a* in the upper end of rod 12, is guyed by a guy rope 13 to a peg 14. A pair of support rods 15 extend upwardly from the ground into grommeted flaps 16 located at the tops of sides 11*b* and guy ropes 17, connected to the tops of rods 15 and to stakes 18, hold the rods 15** in their upright positions.

A top 19 has a central ridge portion **19*a* connected to the peak 11*a* of rear wall 11 and extending upwardly and away from the rear wall to be connected at 20 to a junction 21 between wing portions 22 and 23,** to be hereinafter further explained.

Top 19 has panels **19*b* and 19*c* that are sloped downwardly from the central ridge portion 19*a* to seam connections 19*d* and 19*e* with upstanding side walls 24 and 25, respectively. The panels 19*b* and 19*c* are also, respectively, seamed to the upper edges of wall 11 and to the wing portions 22 and 23.**

Wing portions 22 and 23 are respectively connected to side walls 24 and 25 at seams 26 and to top panels **19*b* and 19*c* at seams 27. The wing portions extend outwardly and upwardly from the top panels and side walls and come together to form a peak 28. A support pole 29 extends upwardly from the ground to a grommet at peak 28** to hold the wings in their upright position.

Door flaps 30 and 31 are respectively sewn to the side wall 24 and top panel **19*b* and to side wall 25 and top panel 19*c*. A zipper 32 releasably connects the door flaps 30 and 31.**

A guy line **32*a* interconnects the top of pole 29 and a spaced stake 33 to hold the pole in an upright position. Tent pegs 34 are driven into the ground through grommeted flaps provided therefore at the lower junction of the rear and side walls, at the lowermost junction of the side walls and wing portions and at the lowermost corners of the edges of the wing portions remote from the side walls. A floor panel 35, FIG. 7, preferably, but not necessarily, sewn into the unit to interconnect the lowermost portions of rear wall 11, and side walls 24 and 25. Fastening devices such as snaps (not shown) or zippers 36 are provided to releasably interconnect the floor panel 35 and front door flaps 30 and 31.**

The basic modular 10, constructed as heretofore described, thus includes a sleeping area within the confines of rear wall 11, top 19, side walls 24 and 25, and front door flaps 30 and 31. In addition, a sheltered area, extending sufficiently high to enable a user therein to stand erect, is formed between the wing portions 22 and 23 and front door flaps 30 and 31. The shelter provides protection from three sides and allows a user to erect the basic tent unit such that when he is within the sheltered area he is quite protected from the elements or hidden from view, as the case may be. The basic unit 10 is preferably made out of lightweight materials such as reinforced, waterproofed nylon for the rear wall, top walls and skirt member, a heavier coated waterproof fabric may be used for the floor and lightweight, telescoping rods and poles, made of aluminum, Fiberglass, or the like. The basic unit 10 can thus be used completely independently as a tent structure and because of its size and the fact that minimum of poles, ropes and pegs are required to tautly erect the tent, it can be conveniently transported and carried, even by back packers.

Figure 5:
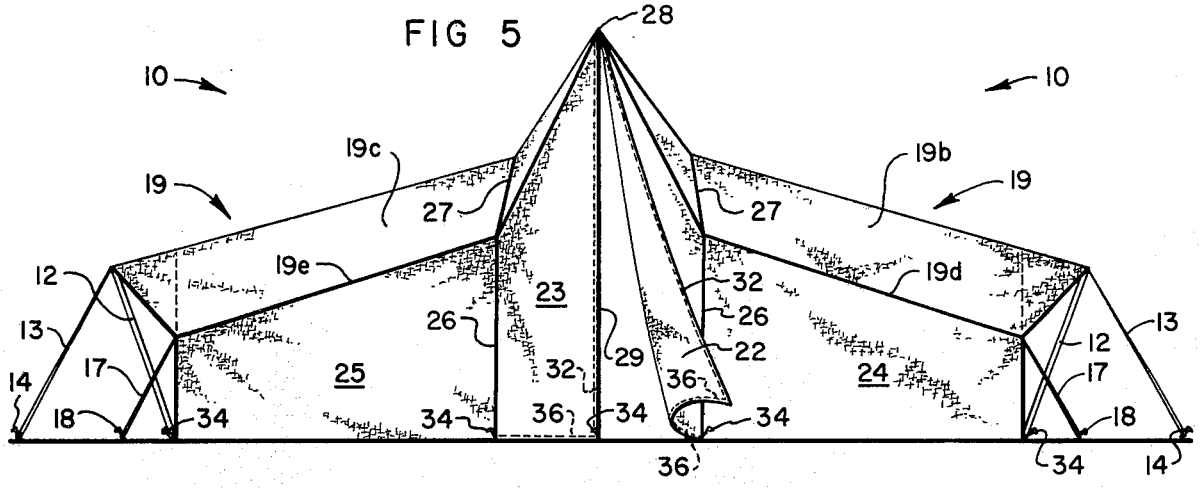

As shown in FIG. 5, it is also possible to couple together two of the basic units 10 by zippering mated portions of zippers 32 on the edges of the wing portions most remote from the walls 25. So constructed, the shelter unit formed has two oppositely positioned, low-profile, sleeping areas of the type heretofore described, and a totally enclosed standing area formed within the interconnected wing portions. As seen from FIG. 5, when two of the basic modular tent units 10 are interconnected the wing portion 22 of the tent unit is zippered to the wing portion 23 of the other tent unit. In addition, only a single pole 29, supporting the wing portions of both tent units at peaks 28, is required.

Figure 6:
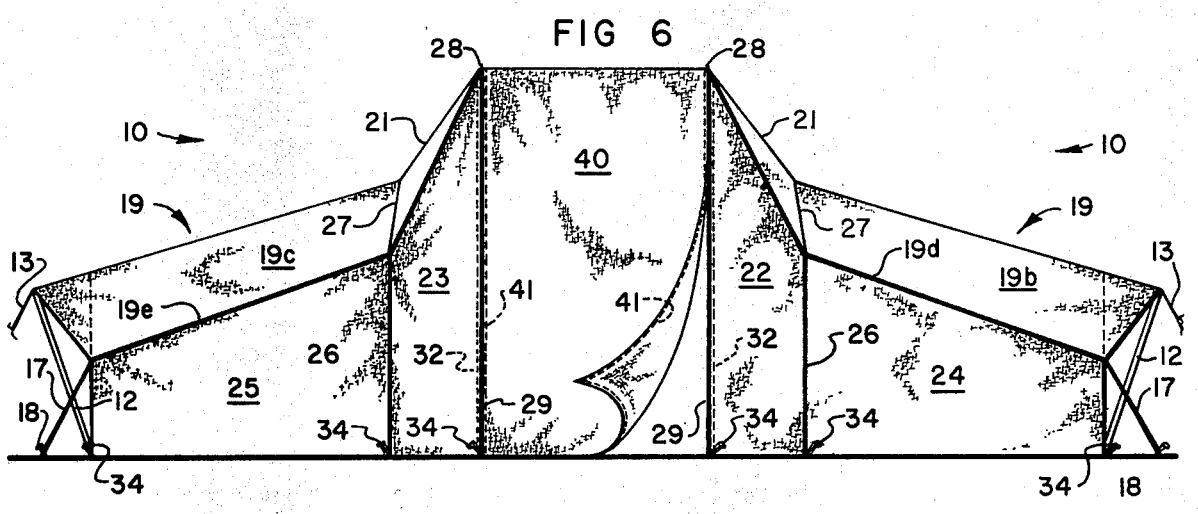
Figure 7:
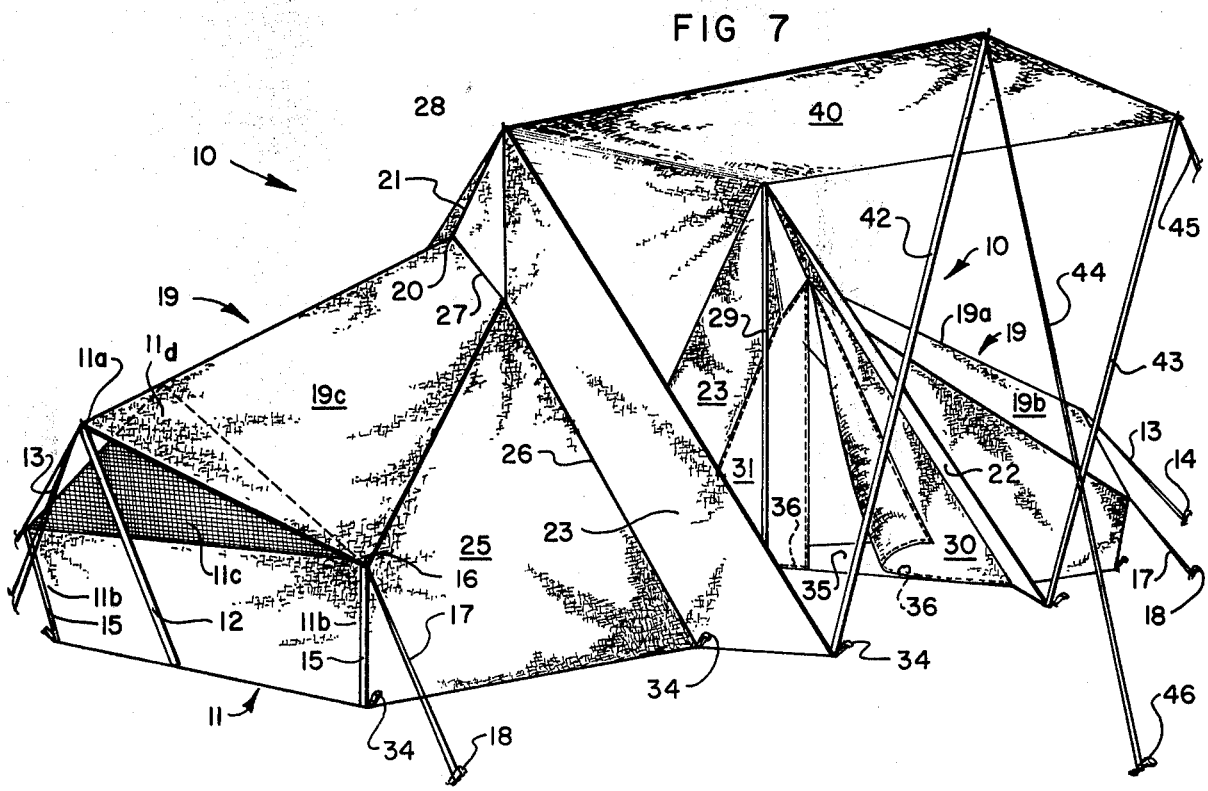

Two of the basic modular tent units 10 can be set up in spaced apart fashion with one or more of the accessory modular units 40 interconnected between the wing portions of the tent units 10. As shown in FIG. 6, this arrangement provides two sleeping areas having low profile roof lines and an enlarged fully enclosed shelter area having a roof line high enough to permit standing therewithin between the sleeping areas. As shown in FIG. 7, one panel of the accessory modular unit 40 can be raised to form an overhead protective awning and can be held in the raised position by ground engaging support poles 42 and 43, having tips inserted through grommets provided therefore in the panel and held in place by lines 44 and 45 that are secured to anchoring pegs 46.

It will also be apparent that a basic modular unit 10, having wing portions 22 and 23 of proper size and with properly arranged track and runner portions of zippers 32 can also be coupled to the structures having suitable mating zipper tracks and runners around an opening conforming in shape to that formed by the zipper portions on wing portions 22 and 23. Thus, the basic modular unit 10 can be readily coupled to and used with a self-supporting pavilion having essentially inverted V-shaped openings, such as that disclosed in my co-pending application for U.S. Ser. No. 104,298, filed Jan. 6, 1971. So connected, the pole 29 need not be used since the wing portion will be fully supported by the pavilion structure.

Although a preferred embodiment of my invention has been herein described, it is to be understood that the present disclosure is made by way of example and that variations are possible, without departing from the scope of the hereinafter claimed subject matter, which subject matter I regard as my invention.

I claim:

1. A tent shelter comprising flexible panel means forming an enclosable sleeping area having a low profile and including door flaps providing access means to the sleeping area;

flexible wing portions integral with and permanently secured to said flexible panel means, extending from around opposite sides of and upwardly from said door flaps, said wing portions being interconnected at upper ends thereof, whereby a shelter area having three ground engaging, interconnected sides and one entirely open side is formed by the flexible panel means forming an enclosable sleeping area and the wing portions, said shelter area having a higher profile than the sleeping area and a highest point at the intersection of the wing portions most remote from the panel means, whereby a user can stand within said shelter area; and means for supporting said flexible panel means and said wing portions in an upright, taut condition.

2. A tent shelter as in claim 1, wherein the flexible panel means forming an enclosable sleeping area includes a rear wall;

side walls connected to said rear wall at opposite sides thereof; and a top interconnecting said rear and side walls, whereby the wing portions are connected to the top and side walls and the door flaps are connected to the top and side walls beneath the top.

3. A tent shelter as in claim 1, further including an accessory tent unit having one side edge releasably coupled to the wing portion and an opposite side edge releasably coupled to another tent shelter.

4. A tent shelter as in claim 1, further including means on edges of the wing portions remote from the flexible panel means for coupling the wing portions to other tent units.

5. A tent shelter as in claim 3, wherein the wing sections provide an essentially triangular opening therebetween, whereby they can be coupled to structure defining correspondingly shaped openings on free standing pavilions.

6. A modular tent shelter comprising flexible panel means forming an enclosable sleeping area having door flaps providing access means to the sleeping area;

flexible wing panels integral with and permanently secured to said flexible panel means, extending from opposite sides of and upwardly from said door flaps said wing panels being interconnected at upper ends thereof and being spread apart at lower ends thereof and each having a zipper portion on the edge thereof remote from the door flaps, whereby a shelter area having three ground engaging interconnected sides and one entirely open side is formed by the flexible panel means forming the enclosable sleeping area and the wing panels, said shelter area having a sufficiently high profile to allow a user to stand therewithin; and means for supporting said flexible panel and said wing panels in an upright taut condition.

7. A modular tent shelter as in claim 6, further including an accessory tent unit having flexible panels defining an opening thereinto and zipper components surrounding the opening and arranged to cooperate with the zipper portions to releasably connect the accessory tent unit to the wing panels.

8. A modular tent shelter comprising a pair of spaced apart enclosable sleeping areas formed by flexible panel means and each having door flaps providing access means thereinto;

ground engaging flexible wing panels integral with and permanently secured to said flexible panel means, extending outwardly from opposite sides of said door flaps and upwardly therefrom, the wing panels at opposite sides of each of the door flaps being interconnected at tops thereof and spread apart at bottoms thereof and peaking at the point of intersection most remote from the panel means;

at least one accessory tent unit releasably interconnecting the flexible wing panels surrounding the door flaps of one enclosable sleeping area with the flexible wing panels of the other enclosable sleeping area, said accessory tent unit comprising flexible panels extending between spaced wing panels; and means for supporting said flexible panels and said wing panels in an upright, taut condition.

* * * * *